US012065282B2

(12) United States Patent
Holzleithner

(10) Patent No.: US 12,065,282 B2
(45) Date of Patent: Aug. 20, 2024

(54) TRANSPORT CONTAINER

(71) Applicants: Peter Entenfellner, Thalheim bei Wels (AT); Andreas Holzleithner, Fischlham (AT)

(72) Inventor: Andreas Holzleithner, Fischlham (AT)

( * ) Notice: Subject to any disclaimer, the term of this patent is extended or adjusted under 35 U.S.C. 154(b) by 77 days.

(21) Appl. No.: 17/616,160

(22) PCT Filed: Apr. 24, 2020

(86) PCT No.: PCT/AT2020/060165
§ 371 (c)(1),
(2) Date: Dec. 2, 2021

(87) PCT Pub. No.: WO2020/243759
PCT Pub. Date: Dec. 10, 2020

(65) Prior Publication Data

US 2022/0242613 A1 Aug. 4, 2022

(30) Foreign Application Priority Data

Jun. 6, 2019 (AT) ..... A 50515/2019

(51) Int. Cl.
*B65D 21/02* (2006.01)
*B65D 25/10* (2006.01)

(52) U.S. Cl.
CPC ..... *B65D 21/0223* (2013.01); *B65D 21/0228* (2013.01); *B65D 21/0235* (2013.01); *B65D 25/107* (2013.01)

(58) Field of Classification Search
CPC ..... B65D 21/0223; B65D 21/0228; B65D 21/0235; B65D 25/107; B65D 21/0217;
(Continued)

(56) References Cited

U.S. PATENT DOCUMENTS 4,619,363 A * 10/1986 Wolfseder ..... A45C 7/005 220/23.6
10,750,833 B2 8/2020 Burcha
(Continued)

FOREIGN PATENT DOCUMENTS

DE 4201264 A1 7/1993
DE 2020015005752 U1 11/2016
(Continued)

OTHER PUBLICATIONS

Espacenet English Abstract for EP 0 555 533 B1, Aug. 10, 1994.

*Primary Examiner* — Andrew D Perreault
(74) *Attorney, Agent, or Firm* — Tiajoloff & Kelly LLP

(57) ABSTRACT

The invention relates to a transport container (1) having an interior (4) which is delimited by a container base (2) comprising guide receptacles and by a container cover (3) which is opposite the container base (2) and from which there project guide bodies (6) on the cover outer side (5) opposite the interior. In order to create a transport container of the type described at the outset which can be stacked reliably and quickly with other transport containers, irrespective of their dimensions, for safe transport in such a way that additional transport securing by separate aids can be dispensed with, it is proposed that the guide bodies (6) having latching recesses (7) are arranged at a distance from one another in a grid, in that, for the releasable fastening of an adjacent transport container (1), a latching device is provided which has latching hooks (8) displaceable along an engagement direction for engagement in the latching recesses (7), and in that the guide bodies (6) within the guide receptacles are limited in the engagement direction.

20 Claims, 5 Drawing Sheets

Figure 1:
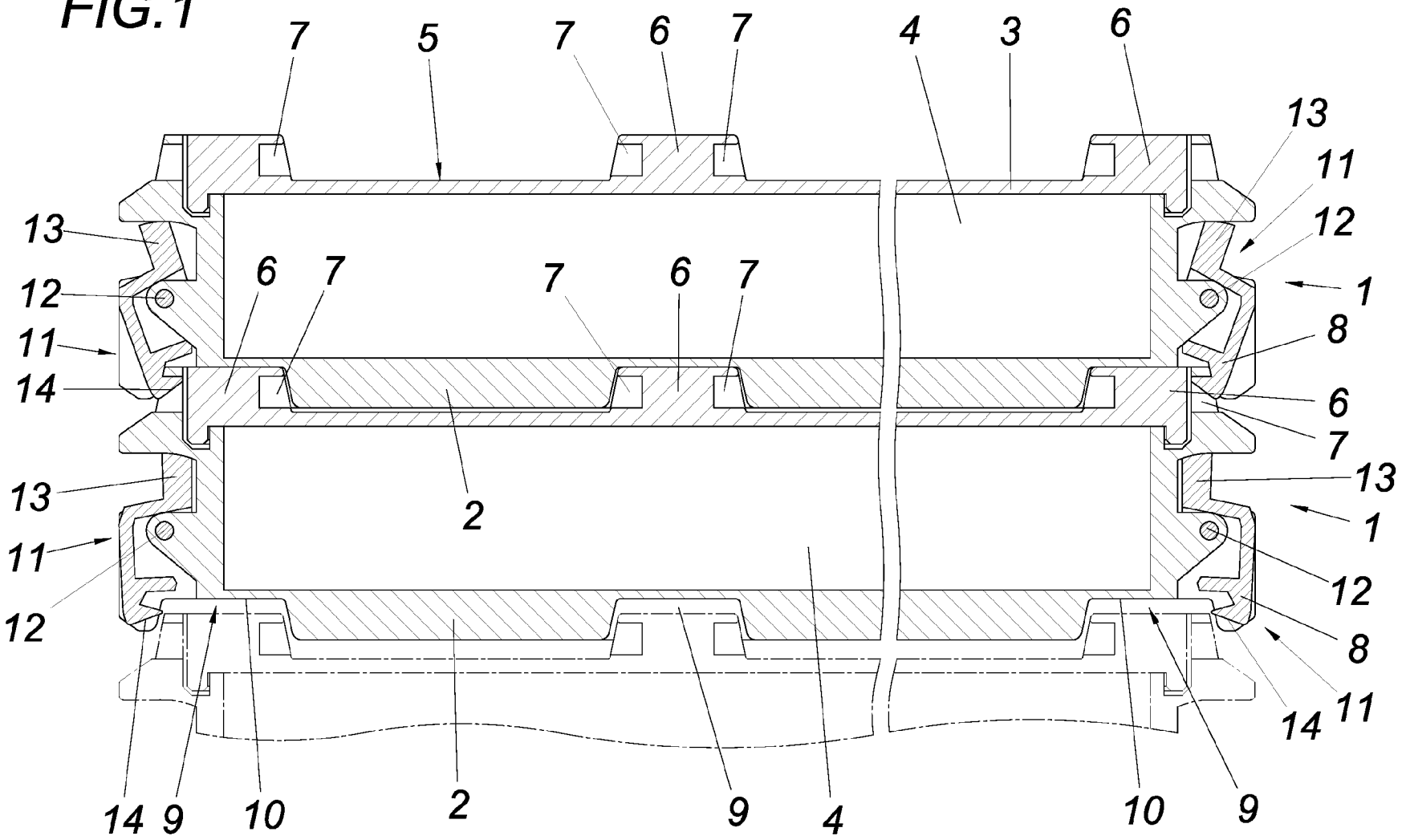

(58) Field of Classification Search
CPC ..... B65D 21/0219; B65D 21/0224; B65D 21/0213; B25H 3/026
USPC ..... 206/598
See application file for complete search history.

(56) References Cited

U.S. PATENT DOCUMENTS

| | | | | |
|---|---|---|---|---|
| 2003/0094392 | A1* | 5/2003 | Meier | B65D 21/0213 206/503 |
| 2006/0254946 | A1 | 11/2006 | Becklin | |
| 2011/0139665 | A1* | 6/2011 | Madsen | B25H 3/026 206/508 |
| 2011/0139666 | A1* | 6/2011 | Sosnovsky | B25H 3/021 206/508 |
| 2011/0155613 | A1* | 6/2011 | Koenig | B65D 21/0223 206/503 |
| 2012/0024739 | A1* | 2/2012 | Fjelland | F16B 45/02 403/321 |
| 2015/0274362 | A1 | 10/2015 | Christopher et al. | |
| 2016/0168880 | A1* | 6/2016 | Phelan | B65D 55/14 206/1.5 |
| 2017/0121056 | A1 | 5/2017 | Wang | |
| 2018/0220758 | A1 | 8/2018 | Burcha | |
| 2019/0308772 | A1* | 10/2019 | Gonitianer | B25H 3/02 |
| 2020/0329837 | A1 | 10/2020 | Burcha | |
| 2020/0346819 | A1* | 11/2020 | Kögel | B25H 3/02 |

FOREIGN PATENT DOCUMENTS

| | | | |
|---|---|---|---|
| EP | 0555533 | B1 | 8/1994 |
| EP | 2990346 | A1 | 3/2016 |
| EP | 3433178 | A1 | 9/2017 |
| WO | 2017/163099 | A1 | 9/2017 |
| WO | 2017/191628 | A1 | 11/2017 |

* cited by examiner

TRANSPORT CONTAINER

FIELD OF THE INVENTION

The invention relates to a transport container having an interior which is delimited by a container base comprising guide receptacles and by a container cover which is opposite the container base and from which there project guide bodies on the cover outer side opposite the interior.

DESCRIPTION OF THE PRIOR ART

Stackable transport containers are known (EP 3433178 A1) which have an interior located between a container base and a container cover opposite the container base. In order to be able to align the transport containers correctly with respect to one another when stacking them one on top of the other, guide bodies are provided which project from the container cover and can be inserted into corresponding guide receptacles let into the container base of an adjacent transport container. However, it is disadvantageous that stacks of transport containers formed in this way must be secured for safe transport with the aid of additional aids, such as tensioning belts or strapping bands. In spite of such securing measures, there is still the risk that, as a result of the transport movements occurring during the course of the transport, corresponding aids such as tensioning belts or strapping bands can become loose or damaged. In the worst case, this can lead to the collapse of a stack of transport containers or to damage to the goods being transported in the transport containers. If, in addition, transport containers of different dimensions are to be combined to form a stack, the measures necessary for safe transport become even more difficult, because care must be taken to ensure that the transport containers are stacked as flush as possible in order to enable the stack to be adequately secured by, for example, tensioning belts, tensioning nets or strapping bands.

SUMMARY OF THE INVENTION

The invention is thus based on the object of creating a transport container of the type described at the beginning, which can be stacked reliably and quickly with other transport containers for safe transport, irrespective of their dimensions, in such a way that additional securing for transport by separate aids can be dispensed with.

The invention solves the given problem in that the guide bodies, which comprise latching recesses, are arranged at a distance from one another in a grid, in that, for the releasable fastening of an adjacent transport container, a latching device is provided which has latching hooks displaceable along an engagement direction for engagement in the latching recesses, and in that the guide bodies are limited by stops within the guide receptacles in the engagement direction.

As a result of these features, a plurality of transport containers according to the invention can be stacked independently of their dimensions and in any position and orientation within the grid predetermined by the guide bodies, because the guide bodies of a transport container engage in each case in the guide receptacles of the adjacent transport container resting with its container base on the guide bodies and are limited there by a stop in at least one direction of engagement. After actuation of the latching device, the latching hooks engage positively in the latching recesses of the guide bodies and thus secure the transport containers relative to one another also counter to the direction of engagement and, due to the positive connection, also in a transverse direction, so that the two transport containers are aligned relative to one another in all spatial directions and are secured to one another. In order to be able to securely connect the stacked transport containers to one another for transport purposes, only the latching device according to the invention is thus necessary as the only fastening measure, so that additional fastening means such as tensioning belts or strapping bands can be dispensed with. In this case, it is no longer necessary to ensure that the stack is as flush as possible. Instead, the grid arrangement of the guide bodies guided in the guide receptacles ensures that the guide bodies of a transport container are always aligned at the correct distance from the latching hooks of an adjacent transport container for a reliable connection. Consequently, the stack structure is freely selectable in its outer geometry, which results in a large number of possible stack variants and thus a high degree of flexibility as well as considerable time savings in the assembly and disassembly of the transport container stacks.

Although transport containers according to the invention can in principle be placed on top of one another for stacking via the guide bodies and guide receptacles, particularly favorable stacking conditions result if the guide receptacles form guide grooves arranged in parallel and extending between two opposite end faces of the container base along a guide direction for a plurality of guide bodies in each case. As a result, the transport containers can not only be placed on top of one another, but can also be displaced relative to one another in the guide direction, i.e. in the direction of the longitudinal extension of the guide grooves, for rapid adaptation of the stack structure. Depending on the orientation of the transport containers and thus of the guide grooves and the guide bodies relative to each other, displacement is possible in the two basic directions defining the grid. Particularly favorable manufacturing conditions are obtained if both the guide grooves transverse to the guide direction and the guide bodies in the two grid directions are spaced apart from each other in a predetermined grid basic dimension. If, in addition, the guide grooves interrupt the end faces of the container base, the transport containers to be stacked can also be pushed onto one another from the outset without having to have been placed onto one another beforehand. The fact that a transport container to be pushed on can be brought essentially from the side to an adjacent transport container results in favorable stacking conditions, particularly in the case of transport containers which are difficult to access from above, for example where the room height is limited at the top. In addition, further transport containers can be subsequently added to or removed from an existing stack of transport containers. In order to facilitate accessibility to the latching device under simple design conditions and to provide sufficient room for movement for the latching hooks despite any transport containers arranged next to one another, it is proposed that a side wall of the container base extending in the guide direction is at least in sections perforated by the guide groove adjoining this side wall for the engagement of latching hooks. For connecting the transport containers in a latching position, the latching hooks of a transport container engage in the latching receptacles of the guide bodies, which are accommodated in the guide groove, of an adjacent transport container. With respect to a reliable connection of the transport containers as well as good handling, it is advantageous if both side walls of the transport container, which are opposite each other and extend in the guide direction, are perforated at least in sections by a respective guide groove adjacent to the side walls. However, one or both side walls can also be completely perforated by the respective adjacent guide groove, so that the respective side wall merges into the guide groove, wherein the groove base adjoins the side wall.

In order to create favorable production conditions as well as to be able to carry out the stack assembly and the stack securing more quickly overall, the latching device can form a latching bracket which preferably extends in the guide direction and can be moved from a latching position into an open position against the force of a return spring and to which individual latching hooks are attached. Since the latching hooks no longer have to be moved individually, but only the latching bracket comprising a plurality of latching hooks has to be moved into a latching position or an open position, generally favorable handling conditions result. To facilitate actuation of the latching bracket, the latter may be inserted into a handle recess of the transport container. The latching bracket together with the latching hooks can be manufactured as an integral component.

In this context, reliable handling results if the latching bracket is arranged rotatably against the force of a return spring on a side wall of the transport container extending in the guide direction and forms an actuating handle with a lever arm, wherein latching hooks are attached to the lever arm opposite the axis of rotation extending in the guide direction. When the actuating handle is actuated, the latching bracket is thus pivoted about the axis of rotation extending in the guide direction, wherein the latching hooks are pulled out of the latching recesses of the guide bodies transversely to the guide direction counter to the direction of engagement. Due to the spring load of the latching bracket, the latching hooks engage automatically in the latching recesses of the guide bodies in the non-actuated case, so that automatic locking of the transport containers to one another is made possible.

In order that transport containers can be placed on top of each other and locked to each other during stacking transversely to the guide direction as well as transversely to the engagement direction without having to manually actuate the latching hooks, it is recommended that latching hooks have a stop surface towards the container base which is inclined with respect to the cover surfaces of the guide bodies and cooperates with said bodies in order to displace the latching hooks into the open position when the latching hooks are placed on the guide bodies. When a transport container is placed on a transport container located thereunder, the respective stop surfaces of the latching hooks initially come to rest on the respective cover surfaces of the guide bodies, wherein the latching hooks are displaced into the open position as a result of the cover surfaces of the guide bodies acting against the stop surfaces thereof as a result of the further plugging movement, before the latching hooks engage again automatically in the latching recesses of the guide bodies as a result of the spring loading.

In order to also eliminate the need for separate actuation of the latching devices when the transport containers are pushed towards one another in the guide direction and transversely to the engagement direction, it is proposed that latching hooks of a latching bracket have contact surfaces inclined both in the guide direction and against the guide direction towards the engagement direction and towards the guide direction, wherein the first and last latching hooks in the guide direction comprise a stop surface extending in the engagement direction towards the latching bracket center. In this case, the latching brackets are initially displaced outwards, i.e. counter to the direction of engagement, into the open position against the force of a return spring on account of their contact surfaces interacting with the guide bodies. When the transport container is pushed further in the guide direction, the latching brackets and thus the latching hooks are displaced back into a latching position as a result of the restoring force and engage in the latching recesses of the guide bodies. If a transport container is now pushed onto an adjacent transport container in such a way that the first latching hook preceding in the guide direction engages in the latching recess of a guide body of the adjacent transport container, the transport container to be pushed on can still be pushed on in the guide direction, but can no longer be pushed back against the guide direction, because the stop surface of the first latching hook extending towards the latching hook center in the engagement direction forms a stop interacting with the latching recess of the adjacent transport container. If, in addition, the transport container is pushed on in such a way that the rearmost, i.e. last, latching hook in the guide direction also engages in a corresponding latching recess of the adjacent transport container, the transport containers cannot be displaced relative to one another either in or against the guide direction and are thus completely secured by the latching devices.

In order to be able to integrate transport containers according to the invention into shelving systems, it is proposed that sliding grooves for sliding rails extending along a sliding direction are provided on side walls of the transport container. In addition, in order to be able to push a plurality of transport containers, which are already connected to one another via latching devices in accordance with the invention, simultaneously into a rack as a transport container group, it is merely necessary to select the spacing between the respective sliding grooves of the stacked transport containers from one another in the direction of the stacking height in such a way that, in the stacked state, this spacing corresponds to the spacing between the respective sliding rails of a rack in the direction of the rack side wall height. If, in addition, the sliding direction coincides with the guide direction, individual transport containers can also be detached from a transport container group which is inserted into a rack. In this case, the sliding rails can be designed in such a way that they release the latching devices of the transport containers so that the latching hooks release the guide bodies. This can be carried out, for example, in that the sliding rail presses inwards against a lever arm of the latching device so that the latching hooks are displaced into the open position.

In this context, it may be desirable if the transport containers inserted into a rack can be connected to the rack itself.

Therefore, the invention also relates to a rack having a transport container according to the invention, the latching device of which projects into the sliding groove, wherein the rack comprises a sliding rail for engagement in the sliding groove. The rack cover may have guide grooves corresponding to the container covers, and the rack cover may have guide bodies corresponding to the grid arrangement of the container covers of the transport containers according to the invention. In order to now connect individual transport containers to the rack, the sliding rails may comprise locking devices for the latching devices projecting into the sliding grooves, wherein, for example, locking bodies of the locking device may engage in a locking body recess of the latching device. These locking devices may, for example, form electromechanical actuators.

BRIEF DESCRIPTION OF THE INVENTION

Figure 2:
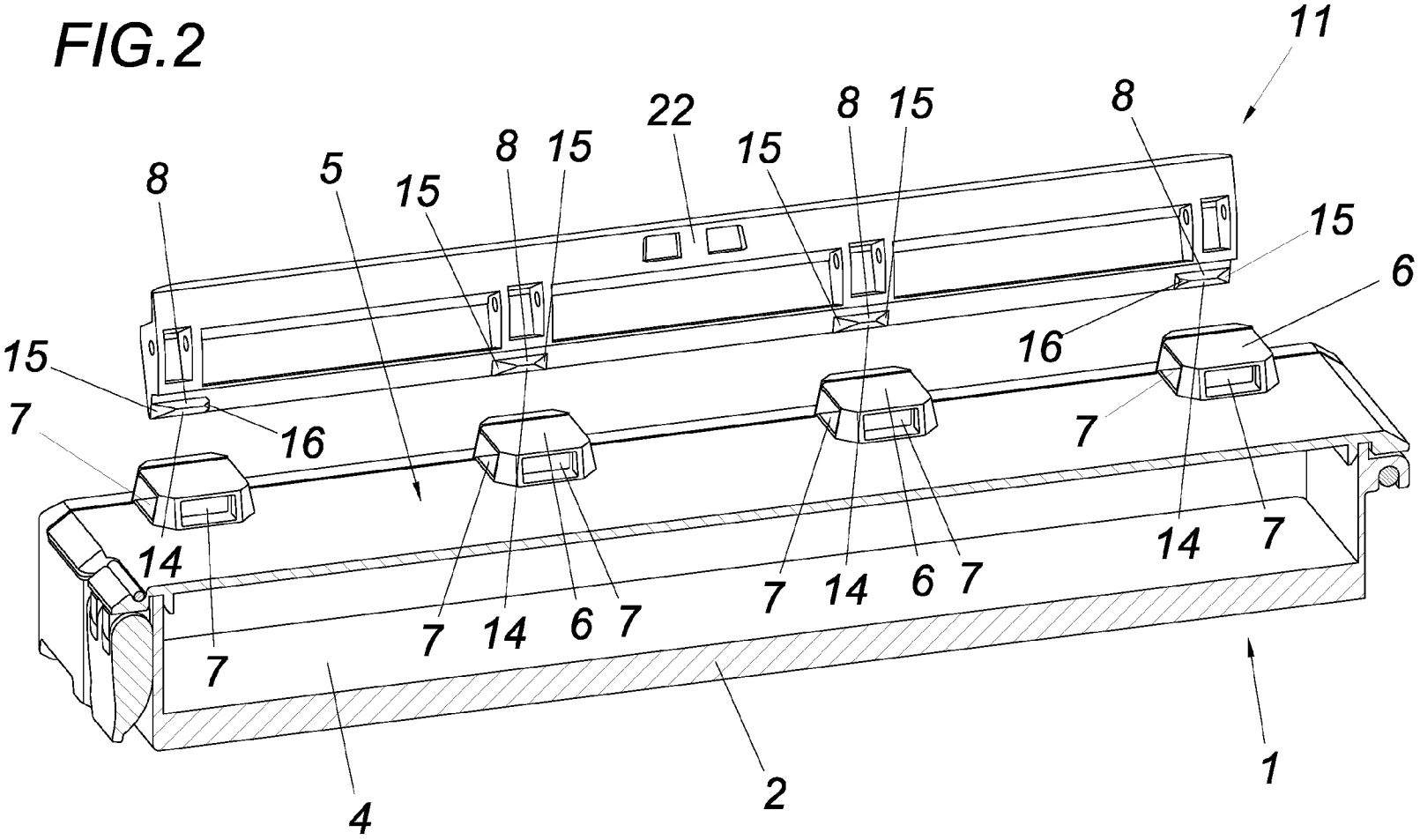
Figure 3:
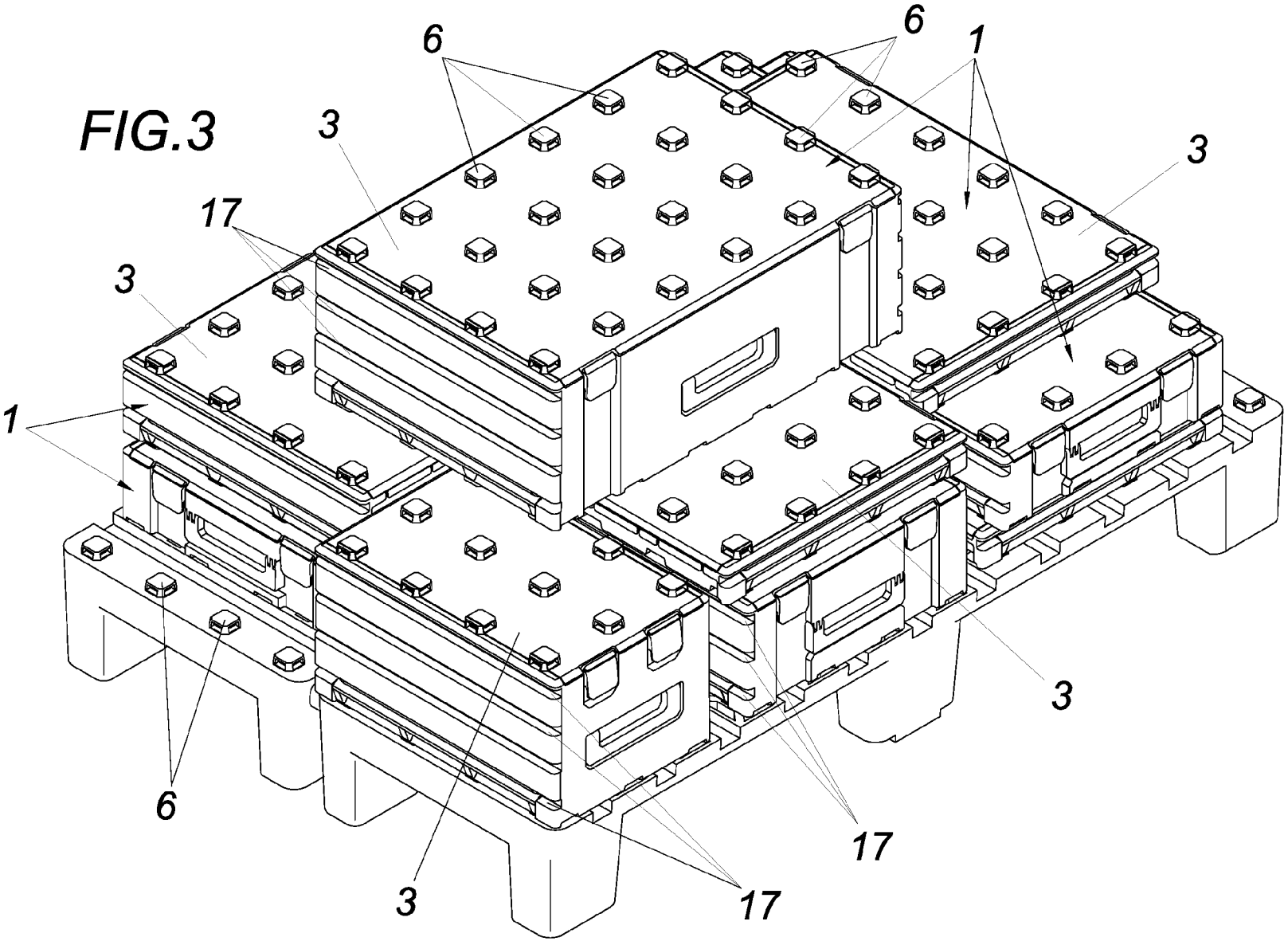
Figure 4:
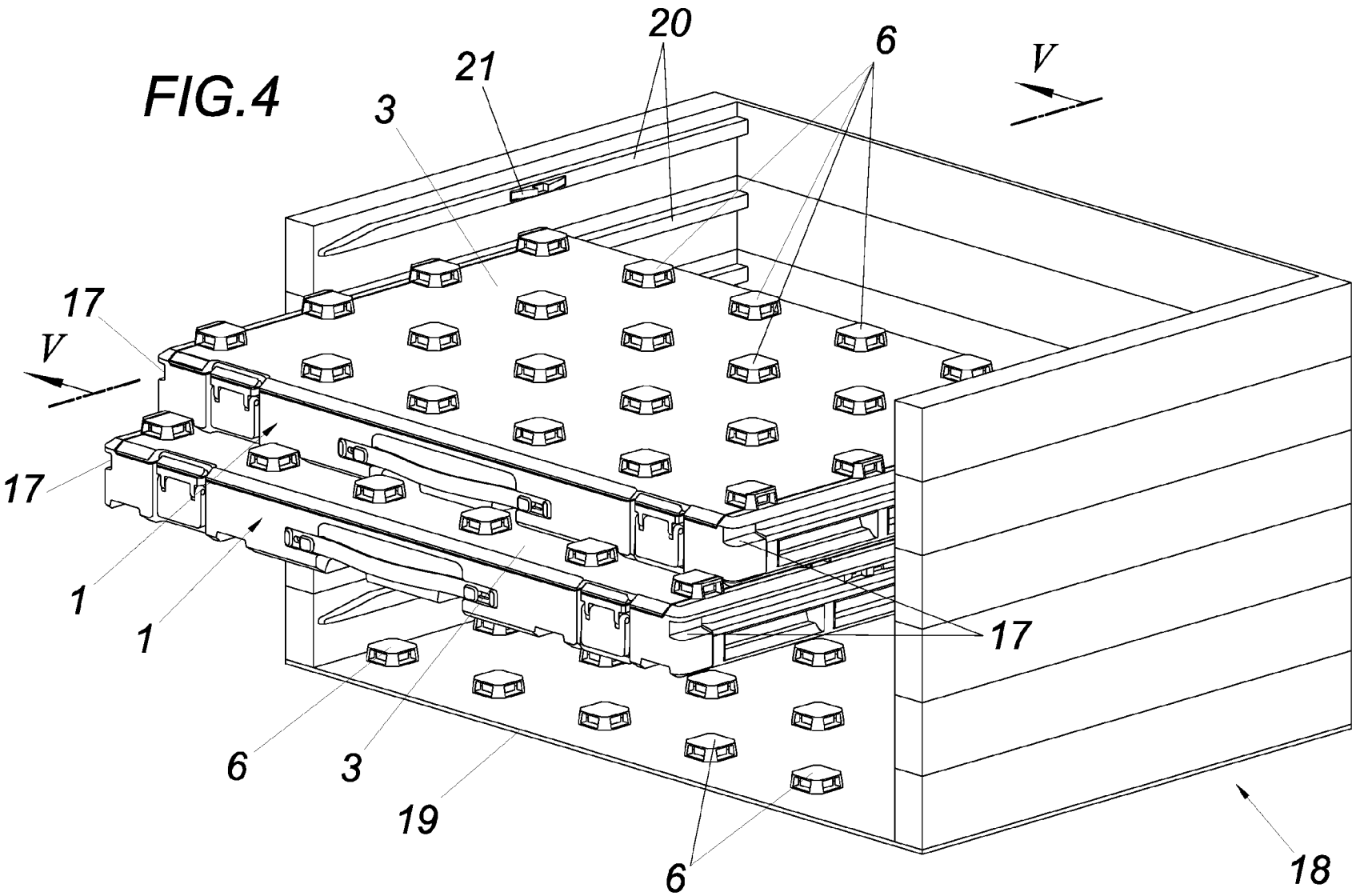
Figure 5:
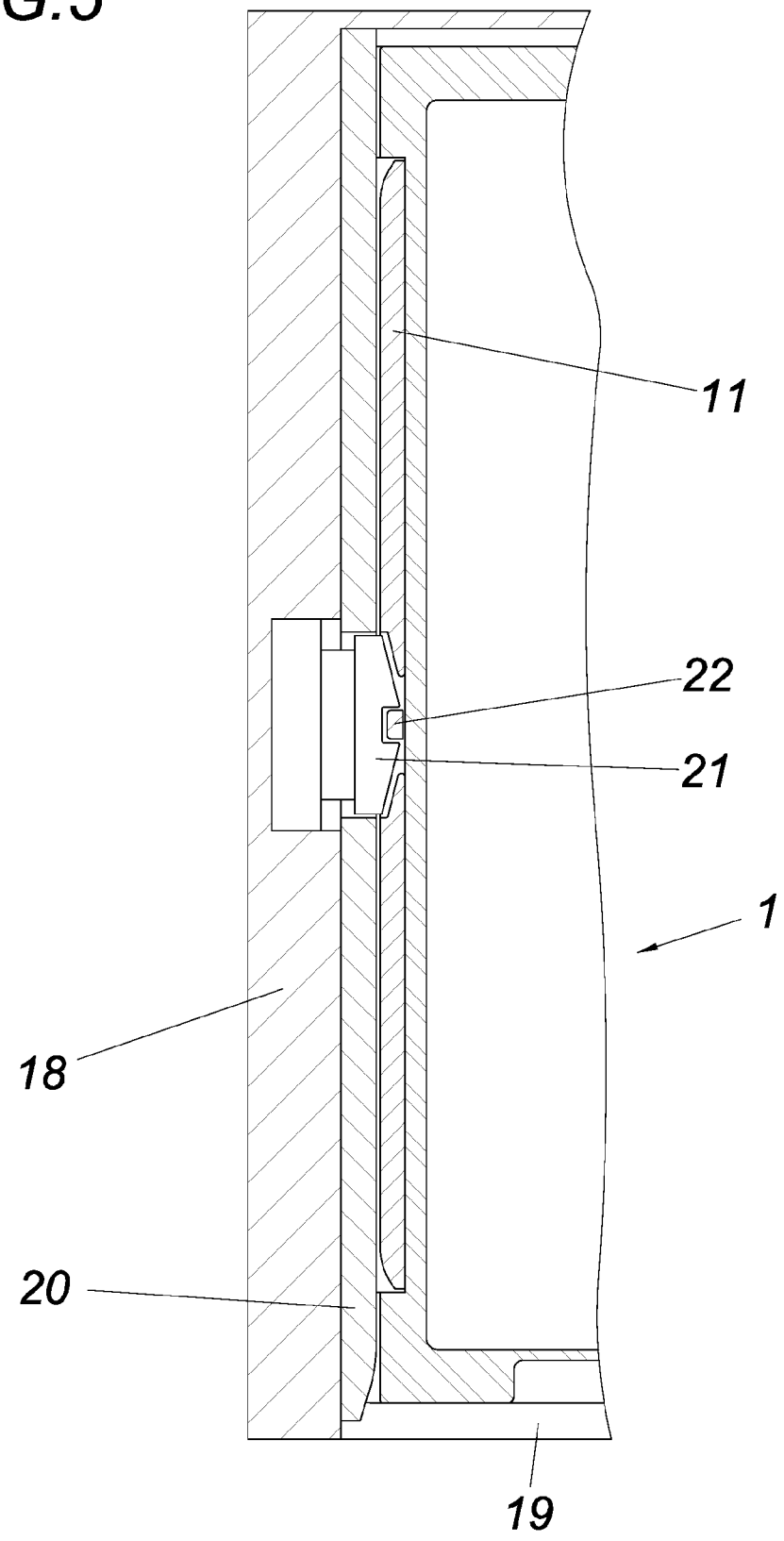

In the drawing, the subject matter of the invention is shown by way of example, wherein:

FIG. 1 shows a schematic section through a group of transport containers according to the invention, FIG. 2 shows an elevated detailed view of a latching bracket with latching hooks and a transport container with guide bodies, FIG. 3 shows a transport container group on a smaller scale, FIG. 4 shows a rack with transport containers according to the invention and FIG. 5 shows a section along the line V-V of FIG. 4 on a larger scale.

DETAILED DESCRIPTION OF THE PREFERRED EMBODIMENTS

A transport container 1 according to the invention comprises a container base 2 and a container cover 3 opposite the container base 2. The container base 2 and the container cover 3 delimit an interior 4 in which transport material can be accommodated. On the outer side 5 of the cover opposite the interior 4, guide bodies 6 are provided which project upwards from this outer side 5 of the cover and are arranged at a distance from one another in a grid. The guide bodies 6 have latching recesses 7, in which latching hooks 8 of adjacent transport containers 1 can engage along a direction of engagement. These latching hooks 8 are displaceable along the direction of engagement between an open position and a latching position shown in FIG. 1.

The container bases 2 can have guide grooves 9 as guide receptacles extending parallel to one another in a guide direction, which form a stop limit for the guide bodies 6 in the direction of engagement. In a particularly preferred embodiment, the guide grooves 9 may extend between two opposite end faces of the container base 2.

In order to allow easy engagement of the latching hooks 8 in the latching recesses 7 of the guide bodies 6, the side walls of the container base 2 extending in the guide direction may be perforated by the guide groove 9 adjacent to the respective side wall, so that the groove base 10 thereof directly adjoins the side wall.

The individual latching hooks 8 may be attached to a latching bracket 11 shown in detail in FIG. 2, which extends in the guide direction. In the embodiment shown, this latching bracket 11 is mounted on a side wall of the transport container 1 extending in the guide direction so as to be rotatable about a rotational axis 12 against the force of a return spring, which is not shown in more detail, wherein the rotational axis 12 also extends in the guide direction. The latching bracket 11 may form two lever arms opposite each other with respect to the axis of rotation 12, one of which comprises an actuating handle 13 and the other of which comprises the latching hooks 8.

In order to enable automatic latching of the latching hooks 8 in the latching recesses 7 of the guide bodies 6 when a transport container 1 is placed on another transport container 1, the latching hooks 8 can have a displacement surface 14 which is inclined towards the container base 2 relative to the cover surfaces of the guide bodies 6, so that the latching hooks 8 are forced back against the force of the return spring when they are placed on a guide body 6, in order to then latch into the latching recesses 7.

As described above, the latching hooks 8 of a latching bracket 11 may have contact surfaces 15 inclined both in the guide direction and against the guide direction towards the engagement direction and towards the guide direction, wherein the first and last latching hooks 8 of a latching bracket 11 in the guide direction comprise towards the latching bracket center a stop surface 16 extending in the engagement direction.

As can be seen in particular from FIGS. 3 and 4, sliding grooves 17 extending in a sliding direction can be provided on the side walls of the transport containers 1, which in a preferred embodiment extend in the guide direction or in the direction of the axis of rotation 12. The rack 18 shown in FIG. 4 comprises a rack base 19 which, analogously to the container covers 3, comprises guide bodies 6 arranged in a grid corresponding to the container covers 3. In addition, the rack 18 comprises a rack cover not shown in detail, which may correspond in construction to a container base 2. The rack 18 comprises a plurality of sliding rails 20 onto which transport containers 1 can be pushed with their sliding grooves 17.

When a transport container group is inserted into the rack 18, the latching brackets 11 can be displaced into the open position, so that the individual transport containers 1 of the inserted transport container group are released from each other again. In order to connect individual transport containers 1 to the rack, the sliding rails 17 may have locking devices 21 for the latching brackets 11 of the latching devices projecting into the sliding grooves 17, wherein locking bodies 22 of the locking device 21 engage in a locking body recess of the latching bracket 11. These locking devices 21 may, for example, form electromechanical actuators.

The invention claimed is:

1. A transport container comprising:

a container base having guide receptacles; and a container cover opposite the container base and delimiting therewith an interior; and guide bodies that project from the container cover on a cover outer side opposite the interior, wherein the guide bodies are arranged at a distance from one another in a grid;

wherein the guide bodies each have latching recesses therein; and wherein the guide receptacles are each configured to receive therein one of a grid of upwardly projecting guide bodies on an adjacent transport container that each have a configuration that is the same as a configuration of the guide bodies of the transport container;

a latching device configured to provide releasable fastening of the transport container to the adjacent transport container; and wherein the latching device has latching hooks displaceable relative to the transport container along an engagement direction and configured to engage in the latching recesses of the guide bodies of the adjacent transport container; and wherein the guide receptacles have stops that are configured to limit movement of the guide body of the adjacent transport container in the guide receptacle beyond a position in the engagement direction when the latching hook is engaged in the latching recess thereof.

2. The transport container according to claim 1, wherein the guide receptacles form guide grooves, arranged in parallel and extending between two opposite end faces of the container base along a guide direction, each guiding a plurality of guide bodies.

3. The transport container according to claim 2, wherein a side wall of the container base extending in the guide direction is perforated at least in sections by the guide groove adjoining said side wall so as to be engaged by some of said latching hooks.

4. The transport container according to claim 1, wherein the latching device forms a latching bracket that can be displaced from a latching position into an open position against force of a return spring, and to which some of the latching hooks are attached.

5. The transport container according to claim 4, wherein the latching bracket is arranged rotatably against the force of the return spring on the side wall of the transport container extending in the guide direction and the latching bracket forms an actuating handle with a lever arm, wherein some of the latching hooks are attached to the lever arm opposite an axis of rotation extending in the guide direction.

6. The transport container according to claim 4, wherein the latching hooks have, towards the container base, a displacement surface that is inclined relative to cover surfaces of the guide bodies of the adjacent transport container and configured to interact therewith, so as to displace the latching hooks into the open position when the latching hooks are placed on the guide bodies.

7. The transport container according to claim 1, wherein side walls of the transport container have sliding grooves receiving sliding rails extending along a sliding direction.

8. A rack having a transport container according to claim 7, wherein the latching device of the transport container projects into the sliding groove, and the rack has a sliding rail engaging in the sliding groove, and wherein the sliding rail comprises a locking device locking the latching device.

9. The transport container according to claim 4, wherein the latching bracket extends in the guide direction.

10. The transport container according to claim 3, wherein the latching device forms a latching bracket that can be displaced from a latching position into an open position against force of a return spring, and to which some of the latching hooks are attached.

11. The transport container according to claim 10, wherein the latching bracket is arranged rotatably against the force of the return spring on the side wall of the transport container extending in the guide direction and the latching bracket forms an actuating handle with a lever arm, wherein some of the latching hooks are attached to the lever arm opposite an axis of rotation extending in the guide direction.

12. The transport container according to claim 2, wherein the latching device forms a latching bracket that can be displaced from a latching position into an open position against force of a return spring, and to which some of the latching hooks are attached.

13. The transport container according to claim 12, wherein the latching bracket extends in the guide direction.

14. A transport container comprising:

a container base comprising guide receptacles and a container cover opposite the container base delimiting therewith an interior; and guide bodies that project from the container cover on a cover outer side opposite the interior, wherein the guide bodies are arranged at a distance from one another in a grid;

wherein the guide bodies have latching recesses therein, and releasable fastening of an adjacent transport container is provided by a latching device that has latching hooks displaceable along an engagement direction engaging in the latching recesses of the guide bodies; and wherein the guide bodies are limited by stops within the guide receptacles in the engagement direction;

wherein the latching device forms a latching bracket that can be displaced from a latching position into an open position against force of a return spring, and to which some of the latching hooks are attached; and wherein the latching hooks of the latching bracket have contact surfaces that are inclined both in the guide direction and counter to the guide direction with respect to the engagement direction and also with respect to the guide direction, wherein first and last of the latching hooks in the guide direction have, towards the latching bracket center, a stop surface that extends in the engagement direction.

15. A transport container comprising:

a container base comprising guide receptacles and a container cover opposite the container base delimiting therewith an interior; and guide bodies that project from the container cover on a cover outer side opposite the interior, wherein the guide bodies are arranged at a distance from one another in a grid;

wherein the guide bodies have latching recesses therein, and releasable fastening of an adjacent transport container is provided by a latching device that has latching hooks displaceable along an engagement direction engaging in the latching recesses of the guide bodies; and wherein the guide bodies are limited by stops within the guide receptacles in the engagement direction;

wherein the latching device forms a latching bracket that can be displaced from a latching position into an open position against force of a return spring, and to which some of the latching hooks are attached; and wherein the latching bracket is arranged rotatably against the force of the return spring on the side wall of the transport container extending in the guide direction and the latching bracket forms an actuating handle with a lever arm, wherein some of the latching hooks are attached to the lever arm opposite an axis of rotation extending in the guide direction; and wherein the latching hooks of the latching bracket have contact surfaces that are inclined both in the guide direction and counter to the guide direction with respect to the engagement direction and also with respect to the guide direction, wherein first and last of the latching hooks in the guide direction have, towards the latching bracket center, a stop surface that extends in the engagement direction.

16. The transport container according to claim 15, wherein side walls of the transport container have sliding grooves receiving sliding rails extending along a sliding direction.

17. A transport container comprising:

a container base and a container cover opposite the container base, said container cover and said container base defining therebetween an interior; and the container cover having thereon guide bodies that project upward from the container cover on a cover outer side opposite the interior, the guide bodies being arranged on the cover spaced from each other in a grid of rows and columns;

the container base having downwardly disposed guide receptacles, wherein each of the guide receptacles is configured to receive therein any one of a grid of upwardly projecting guide bodies on an adjacent transport container, wherein each of the upwardly projecting guide bodies have a configuration that is the same as that of the guide bodies of the transport container;

wherein the guide bodies of the transport container each have two latching recesses therein disposed away from the guide body in opposite lateral directions;

wherein some of the guide receptacles of the transport container have associated therewith a respective latching hook supported for lateral movement relative to the transport container and configured to move in and out of latching engagement in one of the latching recesses of one of the guide bodies of the adjacent container;

said guide receptacles configured to engage an inserted one of the guide bodies of the adjacent transport container so as to prevent lateral movement of said guide body away from the latching hook when in latching engagement therewith.

18. The transport container according to claim 17, wherein the guide receptacles form guide grooves arranged in parallel and extending between two opposite end faces of the container base along a guide direction perpendicular to the lateral direction, each of said guide grooves being configured to receive and guide movement therein of a plurality of the guide bodies of the adjacent transport container such that the transport container can be moved in the guide direction relative to the adjacent transport container.

19. The transport container according to claim 17, wherein each of the guide bodies has an additional two latching recesses facing in opposite directions in a horizontal direction perpendicular to said lateral direction so that the guide bodies each are configured to be latched to by latching hooks of another transport container in any of four sides thereof.

20. The transport container according to claim 17, wherein a plurality of said latching hooks are fixedly supported on a latching bracket, said latching bracket being supported for pivoting movement so as to move the latching hooks thereon in and out of latching engagement, said latching bracket being spring biased to move the latching hooks into latching engagement.

* * * * *